United States Patent [19]

Peter

[11] Patent Number: 5,050,644

[45] Date of Patent: Sep. 24, 1991

[54] COUPLING ARRANGEMENT FOR A LOOM HARNESS SHAFT

[75] Inventor: Hans Peter, Winterthur, Switzerland

[73] Assignee: Sulzer Brothers Limited, Winterthur, Switzerland

[21] Appl. No.: 543,220

[22] Filed: Jun. 25, 1990

[30] Foreign Application Priority Data

Jul. 7, 1989 [CH] Switzerland ..... 2544/89

[51] Int. Cl.[5] ..... D03C 13/00

[52] U.S. Cl. ..... 139/88; 29/240; 29/271; 29/281.5; 901/39

[58] Field of Search ..... 403/12, 11; 29/240, 29/271, 281.5; 74/594.1; 139/88, 87, 82; 901/39

[56] References Cited

U.S. PATENT DOCUMENTS 4,541,459 9/1985 Palau ..... 139/88
4,715,409 12/1987 Graf ..... 139/88
4,770,213 9/1988 Peter ..... 139/88

FOREIGN PATENT DOCUMENTS 2656380 6/1978 Fed. Rep. of Germany .
2466543 4/1981 France .

*Primary Examiner*—Andrew M. Falik
*Attorney, Agent, or Firm*—Kenyon & Kenyon

[57] ABSTRACT

The actuating tool for coupling and uncoupling the coupling elements of the shaft coupling arrangement is rotatably mounted in the loom frame externally of the coupling elements. The tool includes a drive shaft, crank webs which extend transversely of the drive shaft and a pair of rollers which are disposed externally of the coupling elements. Upon pivoting of the tool, the rollers effect coupling or uncoupling of the coupling elements. The tool may be operated automatically and may be constructed so as to guide the individual push rods of the shaft drive when loom shafts are not present.

12 Claims, 7 Drawing Sheets

COUPLING ARRANGEMENT FOR A LOOM HARNESS SHAFT

This invention relates to a coupling arrangement for a loom shaft. More particularly, this invention relates to an actuating tool for a coupling arrangement for a heald shaft in a loom.

As is known, various types of devices have been used for coupling a loom shaft containing heddles and the like to push rods in order to effect a reciprocating movement of the shafts during shedding. For example, German Patent 2656380 describes a coupling arrangement in which each push rod has a coupling part and each shaft has another coupling part for coupling with the coupling part on the push rod. When coupled together, the coupling parts engage one another to form a positive shaft coupling. Upon actuation of a shaft drive, a force is transmitted via the push rods in order to move the shafts. In addition, a pivotable actuating tool is provided for closing and opening the coupling parts relative to each other. This tool is described as being pivotally mounted in the frame of the loom. Basically, the tool is in the form of an oval cross-section rod and engages in a recess of the push rod formed by two resilient arms of the push rod. When coupling is required, the rod is rotated through a 90° angle and, by virtue of the oval cross-section, the rod pushes apart the two resilient arms of the push rod so as to permit movement of the coupling part on a shaft into the recess. After the shaft coupling part has moved between the opened arms of the push rod, the rod is either turned through a further 90° angle in the same direction or turned back to close the coupling.

However, after a shaft has been coupled to a push rod, the actuating tool must be removed from the loom. This is because the actuating tool is disposed in the interior of the push rods and would otherwise impede movement, i.e. vertical movement, of the push rod.

Accordingly, it is an object of the invention to provide a loom with a shaft coupling actuating tool which does not require removal from the loom after a coupling has been infected.

It is another object of the invention to provide a coupling arrangement for a loom shaft which is of compact construction.

It is another object of the invention to simplify the coupling and uncoupling of coupling parts for a loom shaft.

Briefly, the invention provides a coupling arrangement for a loom shaft which includes a coupling element for securement to a loom shaft, a second coupling element for mounting on a push rod, a clutch element pivotally mounted on the second coupling element to couple the two coupling elements to each other and an actuating tool pivotally mounted on a pivot axis for moving the clutch element to couple and uncouple the coupling elements relative to each other. This tool includes a pair of diametrically offset members exterior to the clutch element on the push rod for pivoting about the pivot axis in order to abut and move the clutch element into coupling element with the two coupling elements.

The actuating tool also includes a drive shaft which is disposed on the pivot axis and a crank web which is secured to the drive shaft in perpendicular relation for pivoting therewith about the pivot axis. This crank web serves to mount the members of the tool which effect the coupling engagement. In this case, each member may be in the form of a rotatable roller mounted on one of a pair of parallel spindles which, in turn, are mounted on opposite ends of the crank web.

The tool may also have a second shaft coaxial of the drive shaft and a second crank web secured to this second shaft as well as to the spindles in order to form a frame. Such a frame may be handled as a unit and can be sized to extend around a plurality of coupling arrangements between a plurality of shafts and push rods. Where the tool is used for coupling and uncoupling a plurality of coupling arrangements, each roller may be sub-divided into sub-rollers along the respective spindles. In this case also, a plurality of links may be secured to and across the spindles of the tool in alternating fashion with the sub-rollers in order to define guides for the respective push rods therebetween. These links may be rigidly connected to the spindles while the rollers are connected to the crank webs so that the actuating tool is effective as a torsionally rigid grating or lattice or the like with the coupling elements being movable within the interstices (gaps) of the grating. This actuating tool can be stationary in the loom since, in the normal position with the connecting links horizontal, the tool does not impede vertical movements of the shafts. Indeed, the tool is effective as a guide element for the individual push rods which are not coupled to shafts which are not to be effective in the loom for a particular article to be woven.

The drive shaft of each actuating tool may be connected in common with the drive shaft of other actuating tools to a suitable drive such as an endless chain which, in turn, is connected to a suitable adjusting drive for driving the chain, for example, from a shaft drive unit of the loom.

The actuating tool enables the shafts of a loom to be coupled or uncoupled simultaneously to the respective push rods without requiring substantial force. Due to the construction of the actuating tool, the coupling elements can be compact since the members for effecting coupling are disposed outside the coupling elements. Another advantage of the actuating tool resides in the effectiveness of the tool as a guide element for the push rods of a shedding motion.

In another embodiment, the actuating tool may be actuated by means of a pneumatic actuation motor connected directly to the drive shaft for pivoting the shaft about the pivot axis thereof.

In still another embodiment, the coupling arrangement may be provided with a locking means for securing the coupling elements in coupled relation. Such a locking means may include a first part pivotally mounted on a first axis on the coupling element on the push rod, a second part pivotally mounted on the clutch element on a second axis while being pivotally connected to the first part on a third axis and a spring connected to and between the two parts. The spring serves to hold the two parts in one of a first position with the first, second and third axes in a common plane and a second position with the two parts angularly disposed to each other.

These and other objects and advantages of the invention will become more apparent from the following detailed description taken in conjunction with the accompanying drawings wherein.

Figure 3:
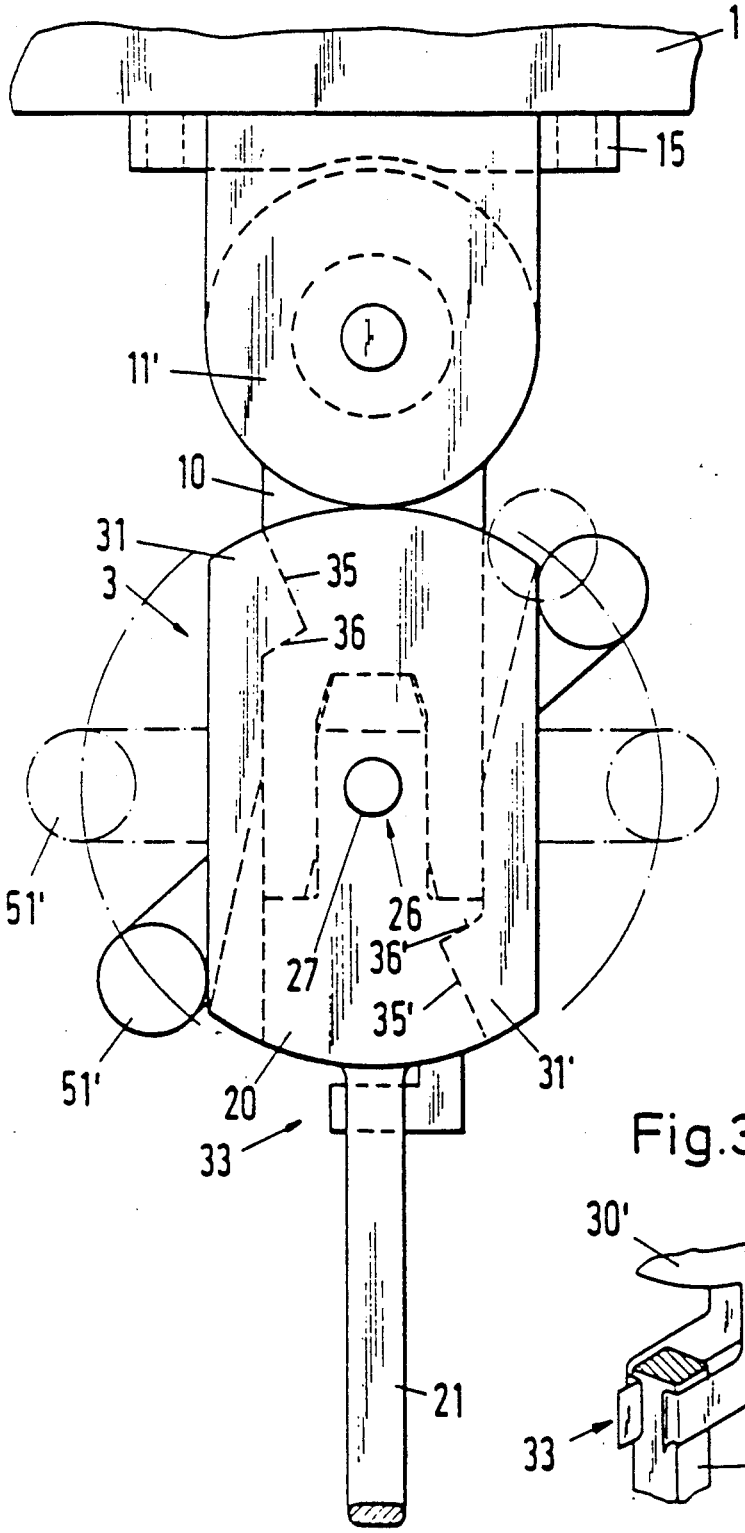
FIG. 3 illustrates a side view of the coupling arrangement in a coupled position.
Figure 3B:
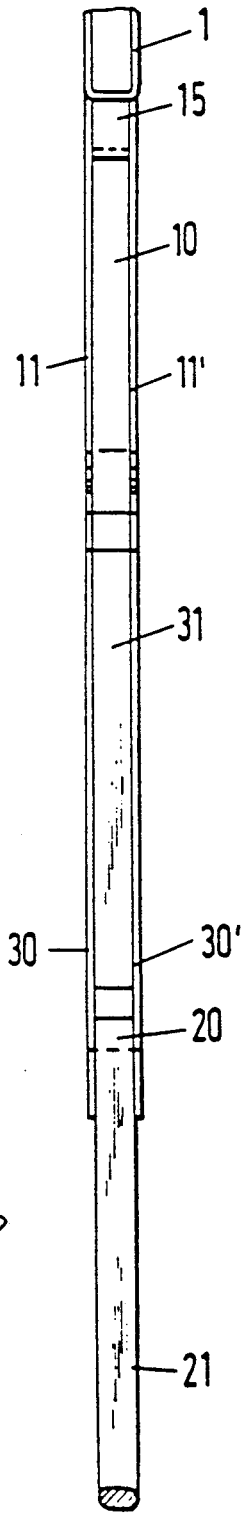
Figure 3A:
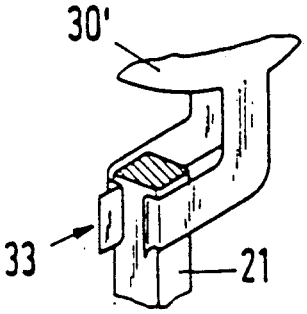
Figure 4:
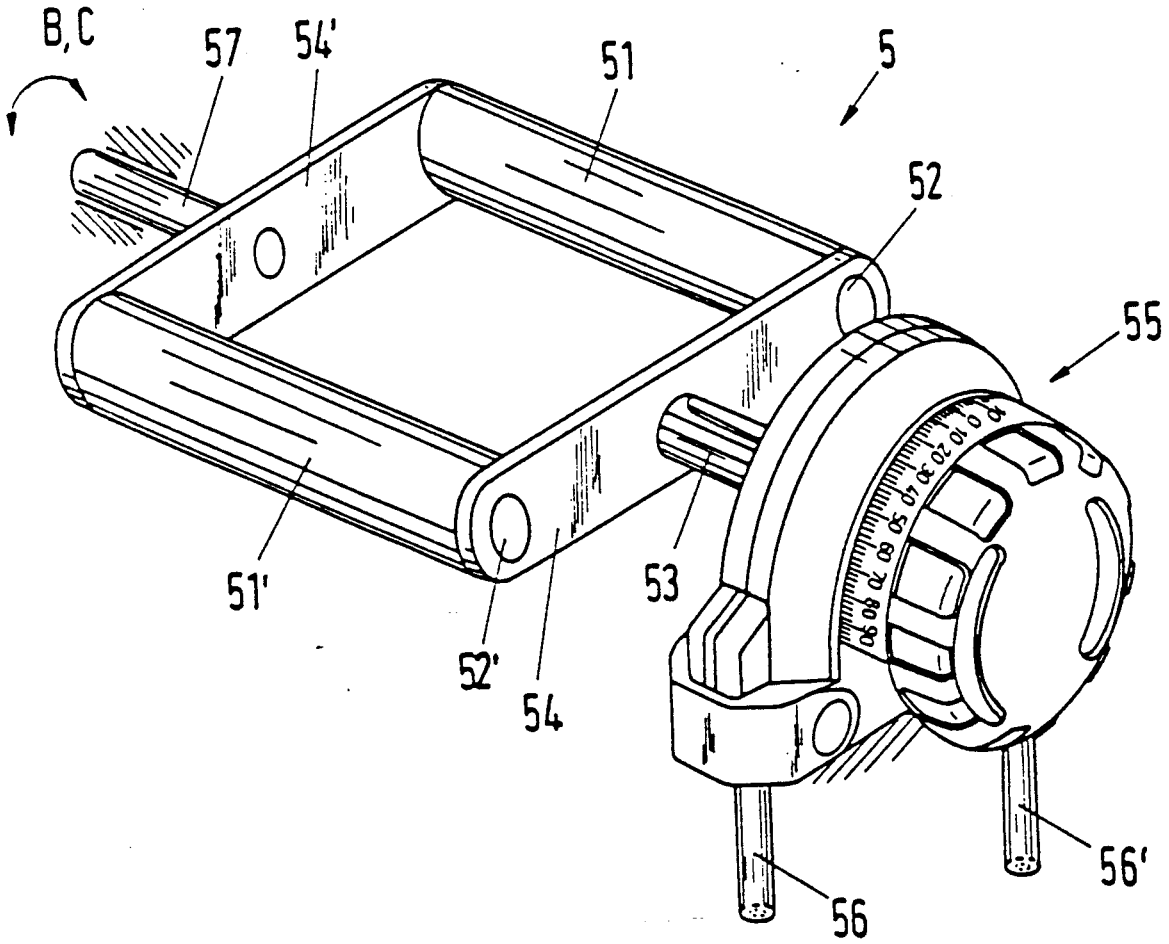
Figure 5:
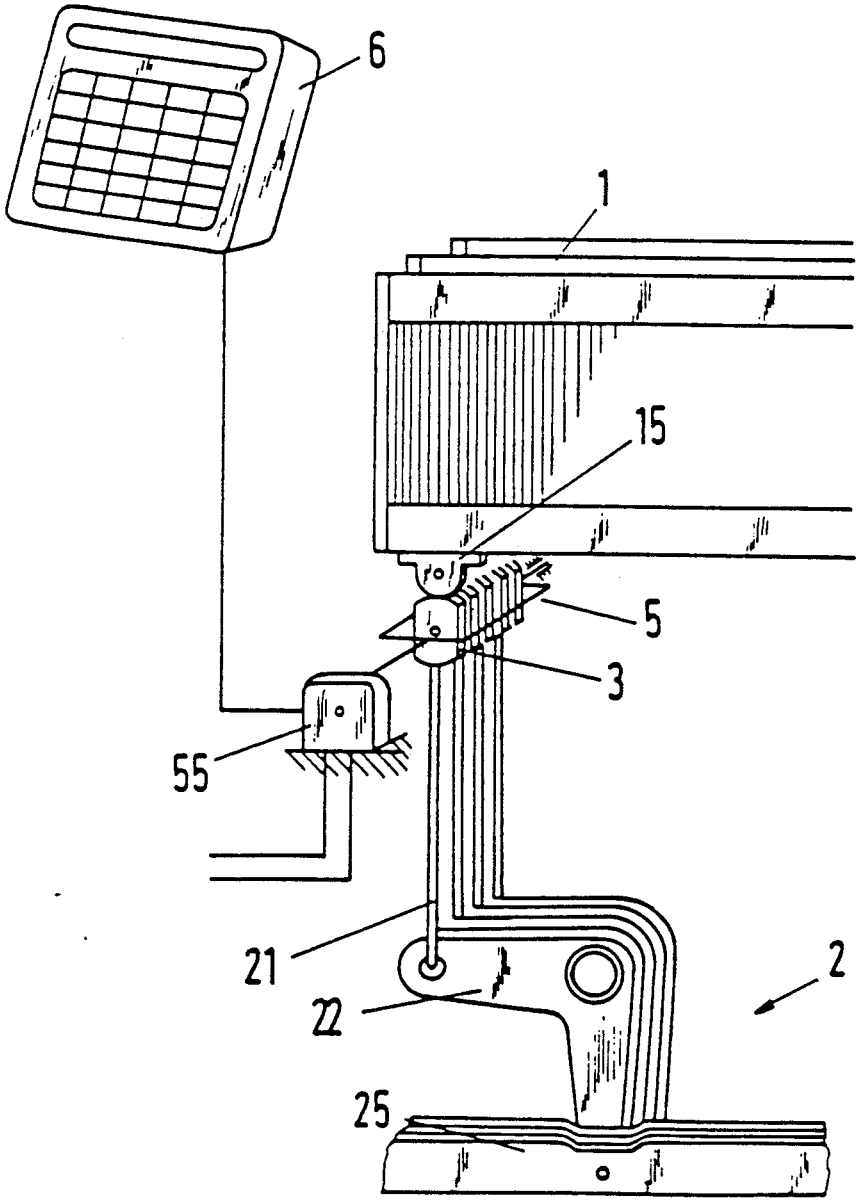
Figures 6, 6A:
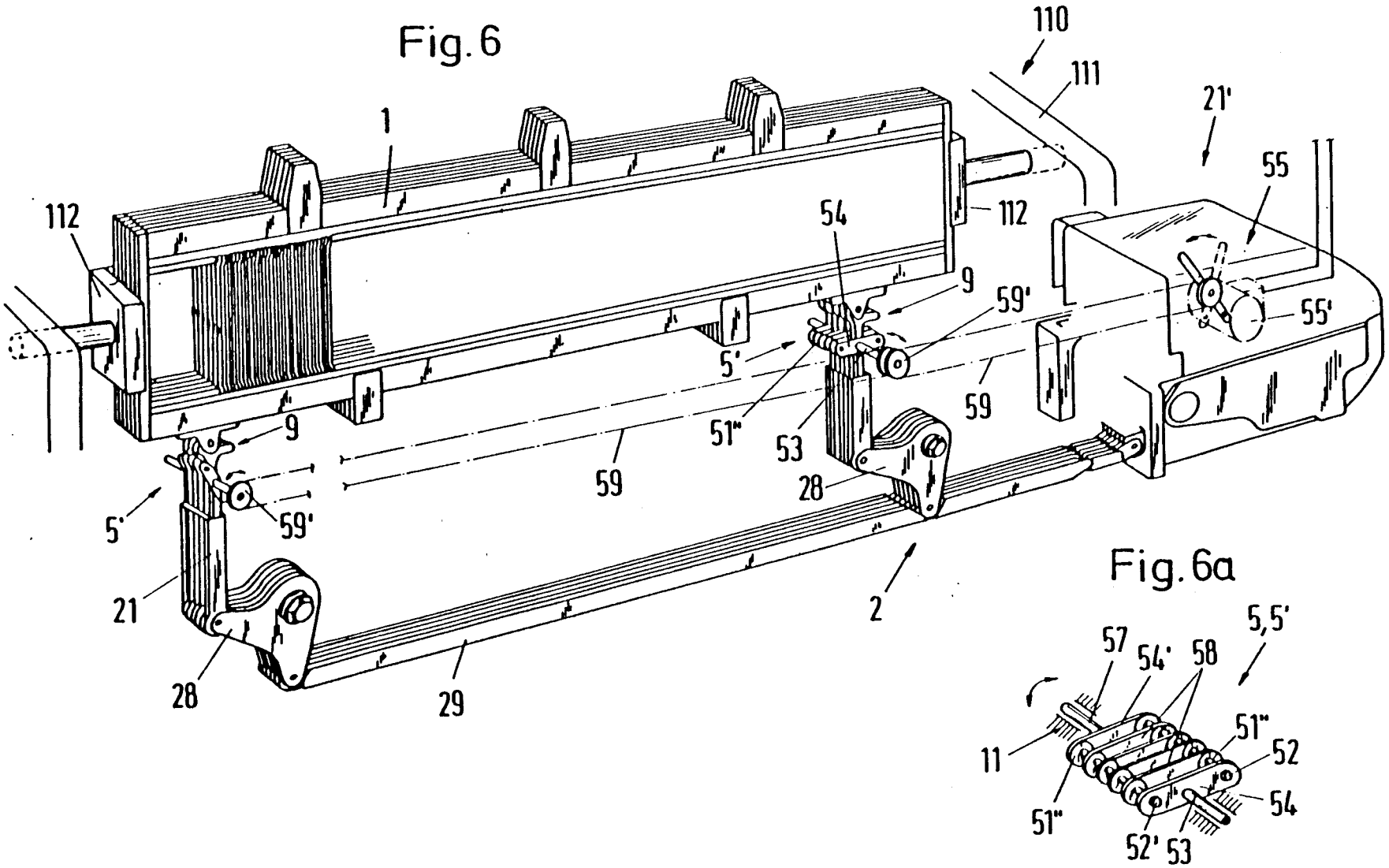
Figure 7B:
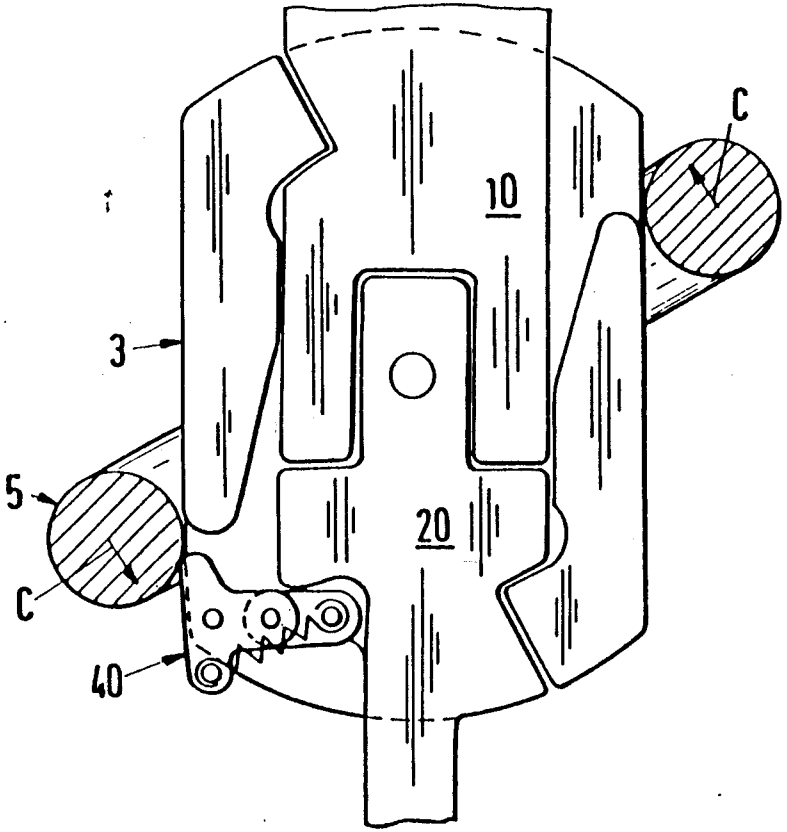
Figure 7A:
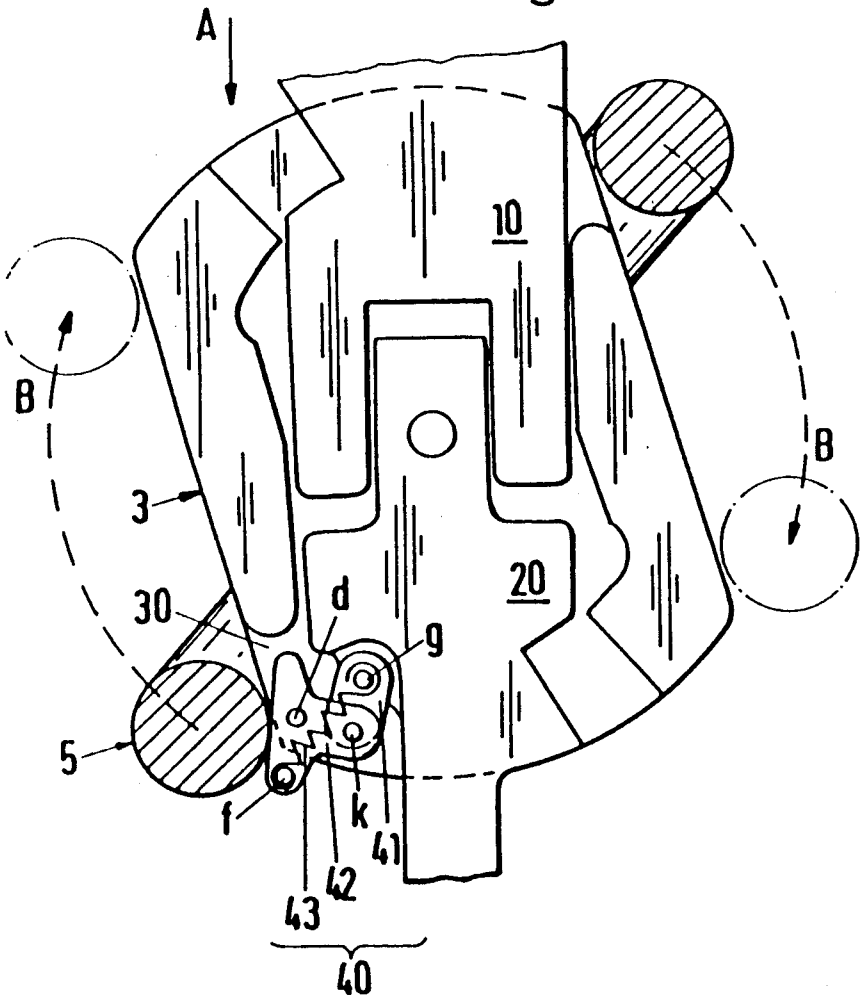

FIG. 3*a* illustrates a detailed view of a locking means for securing the coupling elements in coupled relation;

FIG. 3*b* illustrates a side view of the coupling arrangement of FIG. 3;

FIG. 4 illustrates a perspective view of an actuating tool and a pneumatic actuation motor connected to the tool in accordance with the invention;

FIG. 5 diagrammatically illustrates an actuating system for actuating a coupling arrangement in accordance with the invention;

FIG. 6 illustrates a perspective overview of a complete shaft and drive with actuating tools for a group of shaft couplings in accordance with the invention;

FIG. 6*a* illustrates a modified actuating tool constructed in accordance with the invention;

FIG. 7*a* illustrates a view of a modified coupling arrangement employing a modified locking means in accordance with the invention; and FIG. 7*b* illustrates the coupling arrangement of FIG. 7*a* in coupled relation.

Figure 1:
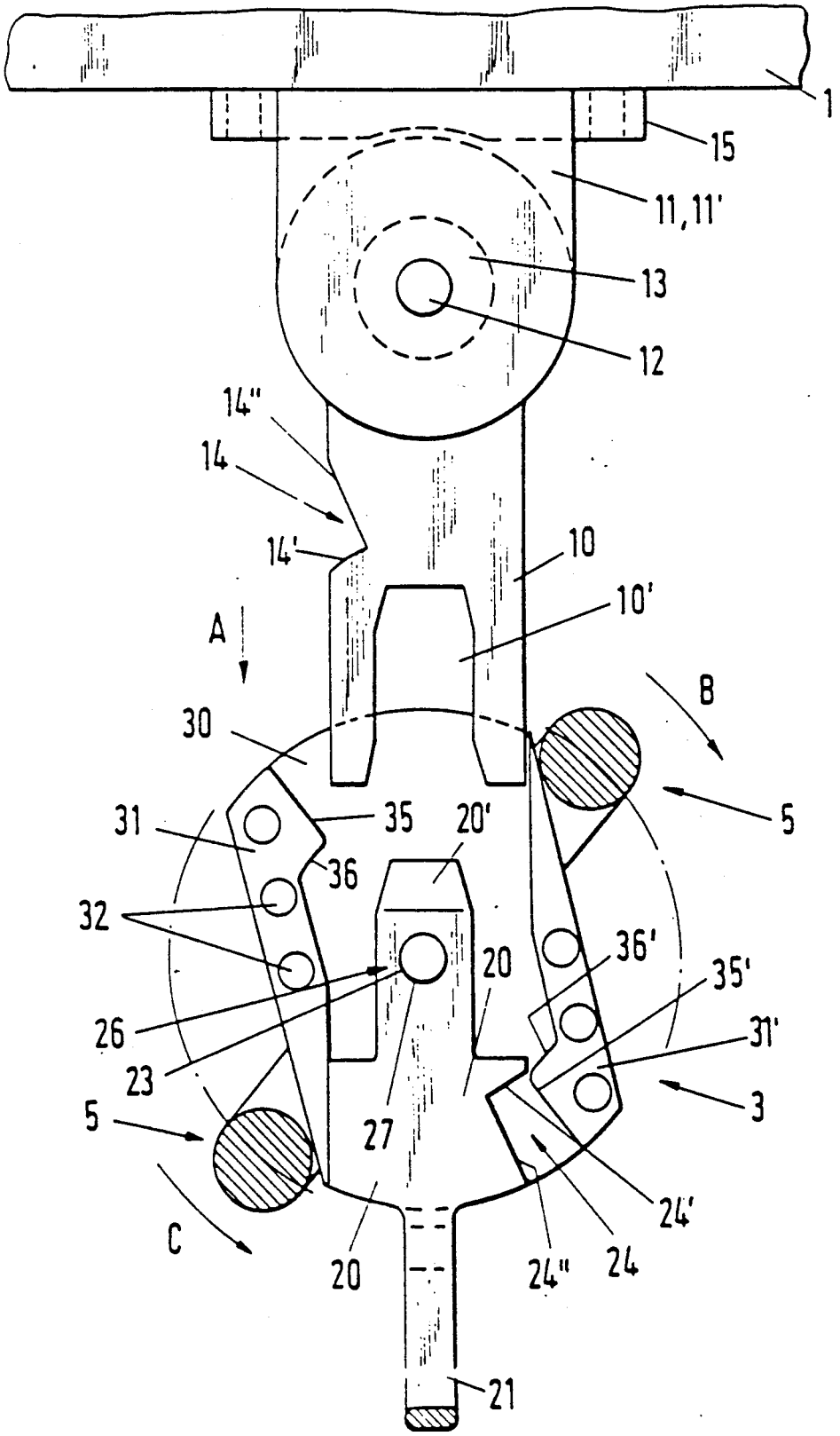
FIG. 1 illustrates a part sectional view of a coupling constructed in accordance with the invention prior to coupling.
Figure 2:
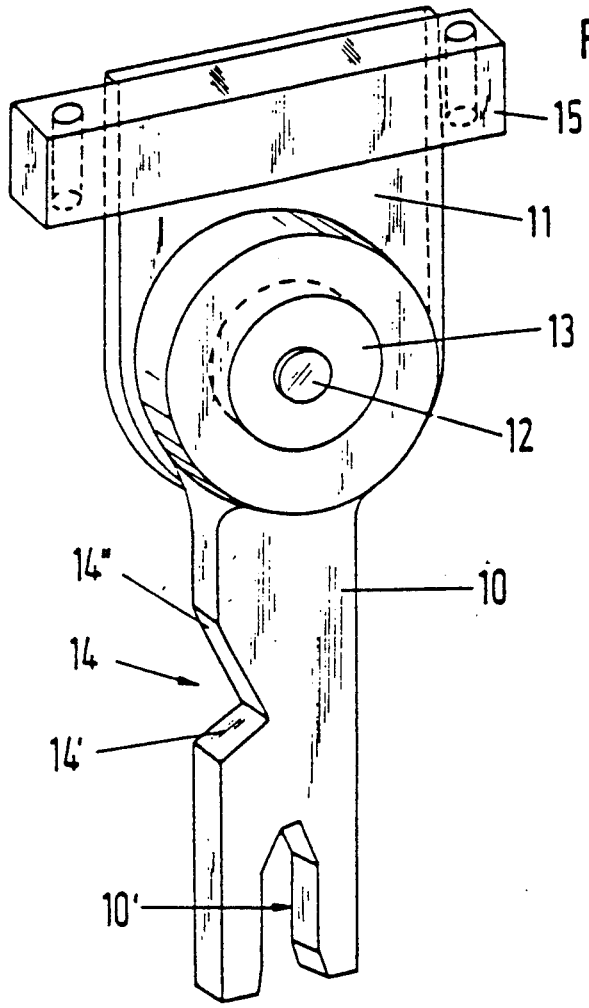
FIG. 2 illustrates an exploded view of the coupling elements of a coupling arrangement in accordance with the invention.
Figure 2:
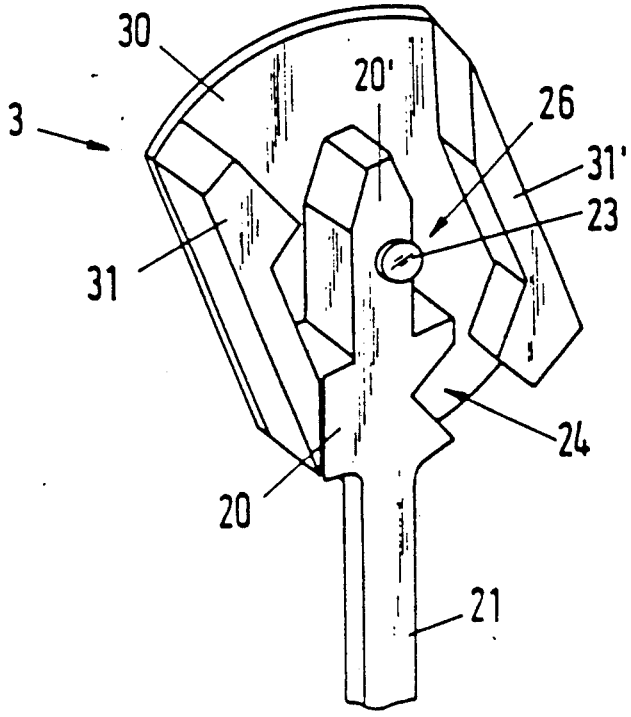

Referring to FIGS. 1 and 2, each coupling arrangement employs a coupling element 10 which is mounted on the bottom of a heald shaft 1 of a loom by means of a suitable support. As indicated, the support includes a carrier 15 which can be secured to the bottom of the loom shaft 1, for example by means of bolts (not shown), a pair of depending lugs 11, 11' which depend from the carrier 15, a pin 12 which is secured between the lugs 11, 11' and a spacer 13 which is mounted concentrically of the pin 12 and which rotatably supports the coupling element 10 thereof. The coupling element 10 also has a recess 10' formed between two rigid arms and a pocket 14 in the external surface which defines a pair of bearing surfaces 14', 14''. This coupling element 10 can be moved vertically with the shaft 1, for example in the direction indicated by the arrow A.

The coupling arrangement also includes a second coupling element 20 which is mounted on a push rod 21 below the coupling element 10. This coupling element 20 includes a projection 20' which is sized to fit into the recess 10' of the coupling element 10. In addition, the coupling element 20 is provided with a pocket 24 in an external surface to define a pair of bearing surfaces 24', 24''.

The coupling arrangement also includes a clutch element 3 having a pair of segmented circular cover plates 30, 30', and a pair of wedges 31, 31', which are secured to and between the plates 30, 30', for example by projection welding at joins 32. Of note, FIG. 2 illustrates the clutch element 3 with only the back cover plate visible. Also, as indicated, each plate 30, 30' is circular with segments being cut off outside the wedges 31, 31'.

A pin 23 is received in a bore in the projection 20' of the coupling element 20 at the upper end of the push rod 21 and acts as a bearing point 26 for the plates 30, 30' of the clutch element 3. In this respect, each plate 30, 30' is provided with a central bore which is effective as a bearing surface 27 on the pin 23. In this way, the clutch element 3 is pivotally mounted on the projection 20'.

In addition, each respective wedge 31, 31' is shaped for mating engagement in the respective pockets 14, 24 of the coupling elements 10, 20. As illustrated, each wedge has a pair of bearing surfaces 35, 36; 35', 36'' for abutting against the respective surfaces 14''; 14'; 24'; 24'', of the pockets 14, 24.

Referring to FIGS. 1 and 4, the coupling arrangement also includes an actuating tool 5 for closing and opening the coupling elements 10, 20 relative to each other. As indicated in FIG. 4, the tool 5 includes a drive shaft 53 which is pivotally mounted on a pivot axis, a crank web 54 which is secured to the drive shaft 53 and a pair of diametrically offset members (shown in solid line in FIG. 1) exterior to the clutch element 3. As indicated in FIG. 4, each offset member is formed by a spindle 52, 52', which is secured to the end of the crank web 54 and a roller 51, 51' which is mounted on a respective spindle for abutting and moving the clutch element 3 upon pivoting of the drive shaft 53.

The tool 5 also has a second shaft 57 coaxial of the drive shaft 53 and a second crank web 54' secured at opposite ends to the spindles 52, 52' so as to form a frame.

As illustrated in FIG. 4, a pneumatic actuation motor 55 is connected to the drive shaft 53 for pivoting the shaft 53 about the pivot axis in the directions indicated by the arrows B, C. The motor 55 is also provided with suitable lines 56, 56' for the supply of compressed air depending up the direction of pivoting desired. A dial is also provided to indicate the angular position of the drive shaft 53 and/or the degree of pivoting of the drive shaft 53 and thus the tool 5.

Referring to FIG. 1, in order to effect a coupling, the tool 5 is rotated in the direction indicated by the arrow C so as to engage the wedges 31, 31' and to rotate the coupling element 3 in a counter clockwise manner, as viewed, for example until the trailing tapered end of the wedge 31 abuts against a flat side wall of the coupling element 20. In the illustrated position, the coupling element 10 is able to receive the projection 20' within the recess 10'. Next, the shaft 1 is moved downwardly so that the coupling element 10 receives the projection 20' in the recess 10' (see FIG. 3). The tool 5 is then rotated in a clockwise direction as indicated by the arrow B in FIG. 1 so that the entire clutch element 3 is rotated with the wedges 31, 31', into mating engagement with the respective pockets 14, 24 of the coupling elements 10, 20.

After coupling is effected, the push rod 21 is able to transmit a vertical movement, for example, from a shaft drive 21' (see FIG. 6) to the shaft 1.

Referring to FIGS. 3, 3*a* and 3*b*, wherein like reference characters indicate like parts as above, a locking means 33 in the form of a snap coupling is provided for securing the coupling elements 10, 20 in coupled relation. As illustrated in FIG. 3*a*, the snap coupling 33 is mounted on the rotatable clutch element 3 to engage over the push rod 21 in the coupled position.

As illustrated in FIG. 3*b*, the coupling arrangement is very slender. Thus, a plurality of shafts, for example twenty shafts may be disposed one beside the other in a loom.

Referring to FIG. 3, the tool 5 can be rotated into a position such that the cylinders 51, 51' are disposed in a common horizontal plane in an operative position of the tool, for example during operation of the loom. In order to effect uncoupling, the cylinders 51, 51' are rotated into the position shown in solid line in order to begin the uncoupling movement.

Referring to FIG. 5, wherein like reference characters indicate like parts as above, after the shafts 1 have been introduced into the loom by a lifter (not shown), for example, at the change of an article in the loom, the loom operator may instruct a control unit 6 to couple the shafts 1 to the push rods 21 so that a shedding operation may begin. To this end, the control unit 6 is able to deliver a suitable signal to the motor 55 so as to pivot the actuating tool 5 into the closed position thereby effecting coupling of the shafts 1 onto the push rods 21. Thus, all of the shafts 1 which are introduced are coupled to the push rods 21. As indicated, a shaft drive 2 is provided for moving the push rods 21. This drive includes a plurality of thrust rods 25 which pivot bent levers 22 which are, in turn, connected to the push rods 21. The thrust rods 25 are actuated by a suitable shedding motion (not shown) of the loom.

As can be gathered from FIG. 3, pulling forces (tension) in the push rod 21 are transmitted via the bearing surfaces 36, 36' on the coupling elements 10, 20, respectively, while pushing forces (compressions) are transmitted through the projection 20' within the recess 10'.

Referring to FIG. 6, wherein like reference characters indicate like parts as above, the loom shafts 1 may be disposed between two shaft guides 112 received in a frame 111 of a loom 110. In addition, an actuating tool 5' is disposed about each coupling arrangement 9 in a manner as described above. As indicated, each coupling arrangement 9 is disposed between a push rod 21 and a loom shaft 1. In this respect, the tool may be used with other types of shaft couplings or for a shaft coupling according to German PS3541042C1.

The tools 5' are connected together for a simultaneous rotation. To this end, the drive shaft 53 of each tool is connected to a drive wheel 59' which, in turn, is articulated to a transmission element 59 such as an endless chain which is driven by an adjusting drive 55' in the shaft drive unit 21'. The adjusting drive 55' can be actuated either manually or by means of a driving motor 55 as indicated in dotted line. As also indicated, the pusher rods 21 are moved by way of bent levers 28, in turn, moved by way of thrust rods 29 which are driven by the shaft drive unit 21'.

Referring to FIG. 6*a*, wherein like reference characters indicate like parts as above, the tool 5, 5' may be modified so as to serve as a guide grating for the push rods (not shown). To this end, the tool 5, 5' has a crank web 54 to which a pair of parallel spindles 52, 52' are connected as above. In addition, the rollers are subdivided into sub-rollers 51'' along the spindles while links 58 are secured to and across the spindles in alternating fashion with the sub-rollers 51''. The links 58 are rigidly secured to the respective spindles 52, 52' and are spaced apart to define guides or gaps for the push rods.

This arrangement of the actuating tool provides a twist-resistant grating while the sub-rollers 51'' are effective as members for actuating the coupling parts of the coupling arrangement.

Referring to FIGS. 7*a* and 7*b*, wherein like reference characters indicate like parts as above, a locking means 40 may be provided for securing the coupling elements 10, 20' in coupled relation rather than using the snap closure of FIG. 3*a*. This locking means 40 includes a first part 41 which is pivotally mounted on a first axis defined by a pin g on the coupling element 20 as well as a second part 42 which is pivotally connected on a plate 30 of the clutch element 3 on a second axis defined by a pin d. In addition, both parts 41, 42 are pivotally connected to each other on a third axis defined by a pin k. A tension spring 43 connects a pin f on the second part 42 to the pin g of the first part 41 in order to hold the parts 41, 42 in one of two stable positions, i.e. a bent position as shown in FIG. 7*a* and a straight position as shown in FIG. 7*b*.

During actuation, the parts 41, 42 of the locking means 40 may reciprocate between the two staple positions. After passing a dead center position in which spring 43 is tensioned most strongly the three axes of the pins f, k, g take up a position as illustrated in FIG. 7*b* in which the axes lie in a common plane. In this position, the coupling is closed and locked in place. In the position illustrated in FIG. 7*a*, the coupling is opened and the parts 41, 42 are angularly disposed with respect to each other.

After the shaft-side coupling element 10 has been introduced into the open shaft coupling element 20 in the direction indicated by the arrow a, the coupling can be closed by pivoting the tool 5 in the direction indicated by the arrow b. Once the coupling clutch element 3 begins to rotate in the clockwise direction, as viewed, the part 42 connected to the plate 30 of the clutch element 3 moves past a dead center position of the tension spring 43 and then snaps over into the straight position illustrated in FIG. 7*b*.

In order to reopen the coupling, the tool 5 is pivoted in a counter-clockwise direction as indicated by the arrow C in FIG. 7*b*. In this case, the tool 5 pushes on a lateral projection of the part 42 thus causing the parts 41, 42 to move from the straight line position shown in FIG. 7*b* to the bent position shown in FIG. 7*a*. This changeover occurs together with the rotation of the clutch element 3.

The invention thus provides a coupling arrangement of relatively simple compact construction and furthermore provides an actuating tool which does not require removal from a loom after actuation.

What is claimed is:

1. In a loom, the combination comprising at least one shaft;

a first coupling element secured to said shaft;

a push rod;

a second coupling element mounted on said push rod for coupling with said first coupling element;

a clutch element for selectively coupling said coupling elements to each other, said clutch element being pivotally mounted on said second coupling element; and an actuating tool pivotally mounted on a pivot axis for moving said clutch element to couple and uncouple said coupling elements relative to each other, said tool including a pair of diametrically offset members exterior to said clutch element for pivoting about said pivot axis to abut and move said clutch element into coupling engagement with said coupling elements.

2. The combination as set forth in claim 1 wherein each said member of said tool is a rotatable roller and said tool includes a pair of parallel spindles mounting a respective roller thereon.

3. The combination as set forth in claim 2 wherein said tool further includes a drive shaft pivotally mounted on said pivot axis and a crank web secured to said drive shaft in perpendicular relation and having said spindles secured at opposite ends thereof.

4. The combination as set forth in claim 3 wherein said tool further includes a second shaft coaxial of said drive shaft and a second crank web secured to said second shaft and at opposite ends to said spindles to form a frame.

5. The combination as set forth in claim 1 which further comprises a locking means for securing said coupling elements in coupled relation, said locking means including a first part pivotally mounted on a first axis on said second coupling element, a second part pivotally mounted on said clutch element on a second axis and pivotally connected to said first part on a third axis and a spring connected to and between said parts to hold said parts in one of a first position with said first, second and third axes in a common plane and a second position with said parts angularly disposed to each other.

6. In a loom, the combination comprising a plurality of shafts;

a plurality of first coupling elements, at least two of said coupling elements being mounted on a respective shaft;

a plurality of push rods for reciprocating said shafts;

a plurality of second coupling elements, each said second coupling element being mounted on a respective push rod for coupling with a respective first coupling element;

a plurality of clutch elements, each clutch element being pivotally mounted on a respective second coupling element for coupling said first and second coupling elements together; and a pair of actuating tools, each tool being pivotally mounted on a pivot axis passing through respective second coupling elements, said tool including a pair of diametrically offset members exterior to said clutch elements for pivoting about said pivot axis to abut and move said clutch elements into engagement with said respective first and second coupling elements.

7. The combination as set forth in claim 6 wherein each said member of said tool is a rotatable roller and said tool includes a pair of parallel spindles mounting a respective roller thereon.

8. The combination as set forth in claim 7 wherein said rollers are subdivided into sub-rollers along said spindles and wherein each said tool includes links secured to and across said spindles thereof in alternating fashion with said sub-rollers thereof to define guides for respective push rods therebetween.

9. The combination as set forth in claim 6 wherein each tool includes a drive shaft on said pivot axis thereof and which further comprises an endless chain articulated to each, drive shaft for simultaneous rotation of each drive shaft and an adjusting drive for driving said chain.

10. An actuating tool for a coupling arrangement in a loom, said tool comprising a drive shaft disposed on a pivot axis;

a crank web secured to said drive shaft in perpendicular relation for pivoting therewith about said axis;

a pair of spindles secured to said crank web in parallel relation; and a pair of rollers, each roller being mounted on a respective spindle for abutting and moving a coupling element of a coupling arrangement upon pivoting of said drive shaft.

11. An actuating tool as set forth in claim 10 further comprising includes a second shaft coaxial of said drive shaft and a second crank web secured to said second shaft and at opposite ends to said spindles to form a frame.

12. An actuating tool as set forth in claim 11 which further comprises a pneumatic actuation motor connected to said drive shaft for pivoting said shaft about said pivot axis.

* * * * *